US009486071B2

(12) United States Patent
Nassif

(10) Patent No.: US 9,486,071 B2
(45) Date of Patent: Nov. 8, 2016

(54) 360 DESK/TABLE: BACK AND NECK SAVER AND PAIN RELIEVER DESK

(71) Applicant: Jerius Youssef Nassif, Valley Cottage, NY (US)

(72) Inventor: Jerius Youssef Nassif, Valley Cottage, NY (US)

( * ) Notice: Subject to any disclaimer, the term of this patent is extended or adjusted under 35 U.S.C. 154(b) by 0 days.

(21) Appl. No.: 14/792,578

(22) Filed: Jul. 6, 2015

(65) Prior Publication Data

US 2016/0051043 A1 Feb. 25, 2016

Related U.S. Application Data

(60) Provisional application No. 62/022,271, filed on Jul. 9, 2014.

(51) Int. Cl.

| | |
|---|---|
| ***A47F 5/12*** | (2006.01) |
| ***A47B 21/02*** | (2006.01) |
| ***A47B 13/08*** | (2006.01) |
| ***A47B 21/04*** | (2006.01) |

(52) U.S. Cl.

CPC ..... *A47B 21/02* (2013.01); *A47B 13/081* (2013.01); *A47B 21/04* (2013.01); *A47B 2200/0042* (2013.01)

(58) Field of Classification Search

CPC ..... A47B 21/02; A47B 21/03; A47B 21/04; A47B 13/081; A47B 2200/0042; A47C 16/00

USPC ..... 108/3–6, 8–10, 108–110, 189, 138, 108/147.16, 147.17, 50.01

See application file for complete search history.

(56) References Cited

U.S. PATENT DOCUMENTS 4,669,691 A * 6/1987 Solomon ..... F16M 11/00 248/165
4,684,091 A * 8/1987 Moreschi ..... F16M 11/00 211/182
4,754,711 A * 7/1988 Solomon ..... F16M 11/00 108/8
4,779,922 A * 10/1988 Cooper ..... A47B 21/03 248/918
4,938,153 A * 7/1990 Maes ..... A47B 23/046 108/128
5,088,420 A * 2/1992 Russell ..... A47B 21/00 108/106
5,117,986 A * 6/1992 Lin ..... A47B 57/20 108/2
5,407,249 A * 4/1995 Bonutti ..... A47B 21/0371 248/118
6,021,535 A * 2/2000 Baus ..... A47C 7/72 297/217.3
6,135,032 A * 10/2000 Ko ..... A47B 9/083 108/147.21
6,203,109 B1 * 3/2001 Bergsten ..... A47B 21/0371 297/411.35
6,425,631 B1 * 7/2002 Lin ..... A47B 21/03 297/170
7,100,517 B1 * 9/2006 Godwin ..... A47B 21/02 108/2
9,091,392 B1 * 7/2015 Addington ..... F16M 11/10
2002/0140265 A1 * 10/2002 Davis ..... A47C 1/16 297/352
2004/0025754 A1 * 2/2004 Dye ..... A47B 83/001 108/50.01
2007/0012827 A1 * 1/2007 Fu ..... A47B 23/007 248/163.1
2007/0236053 A1 * 10/2007 West ..... A47C 16/00 297/4

* cited by examiner

*Primary Examiner* — Hanh V Tran

(57) ABSTRACT

The "360 DESK/TABLE: BACK & NECK SAVER and PAIN RELIEVER DESK" is a flexible desk designed to help people with spinal-cord problems by allowing them to work on a laptop, read a book or write while resting their backs flat on a floor or in a recliner chair. Flexible meaning that its desk deck(s) can be raised/lowered and rotated/tilted about an x-y axis to suit any height and angle of sitting/lying-back position, including sitting on a floor or a pillow, or lying-back flat. The "360 DESK" comes in two models: Single-Sided Model, which has one deck on one side only, and a Double-Sided Model with two decks, one on each side completely independent of each other. Either model is light in weight and does not require designated space in a room and can be easily moved by a child.

5 Claims, 12 Drawing Sheets

FIGURE 1: Computer generated 3D model of the "Double Sided Desk" model. Refer to "LEGEND" on page 24.
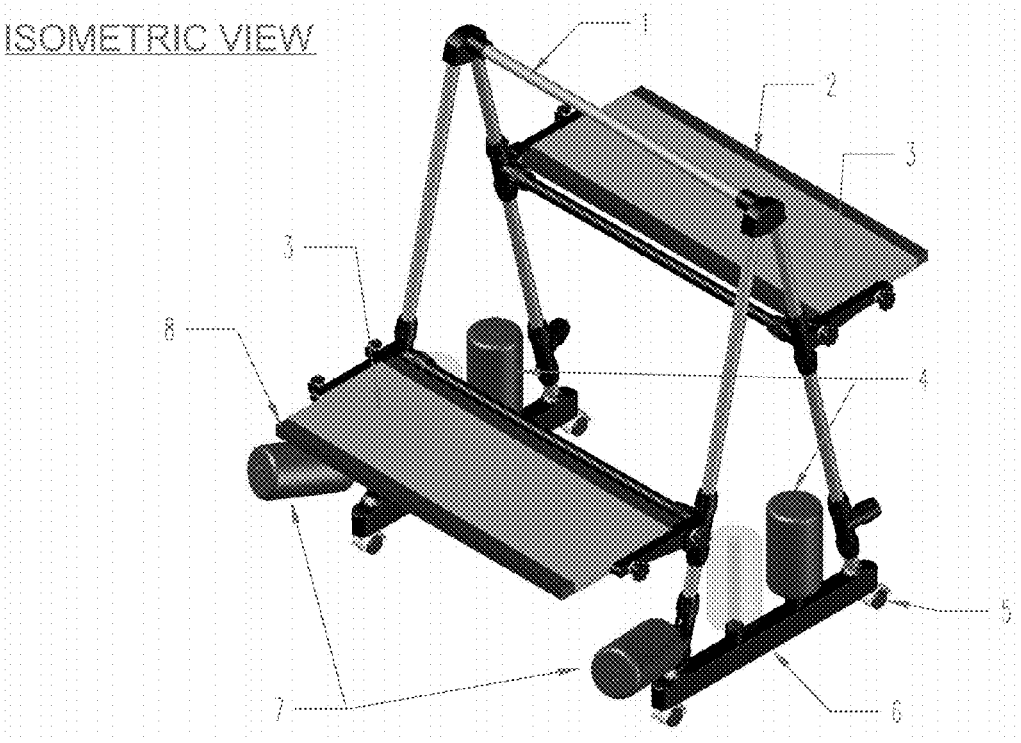
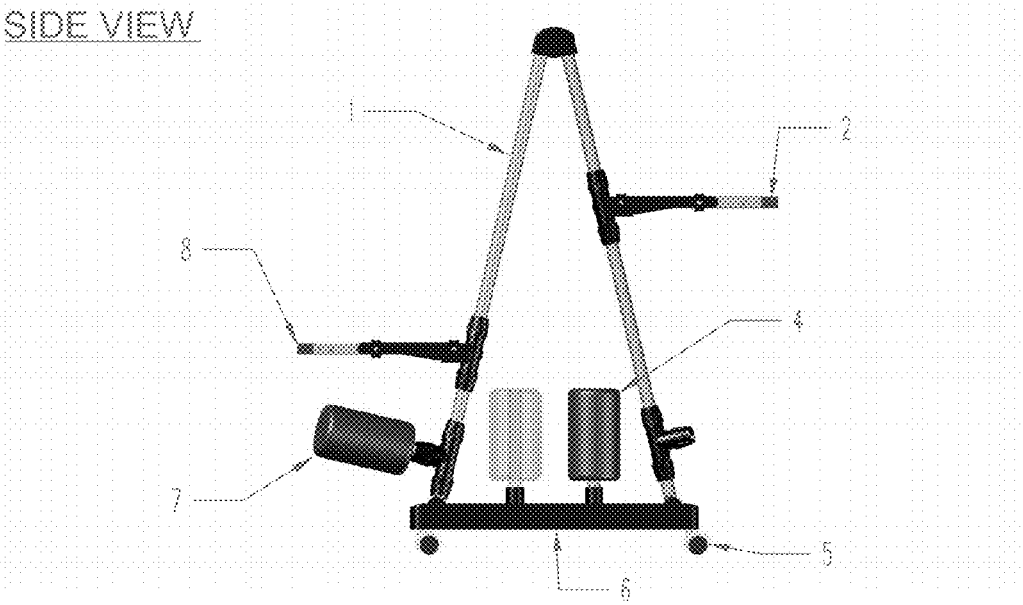

FIGURE 2: "Double Sided Desk"/ Decks height versatility illustration.
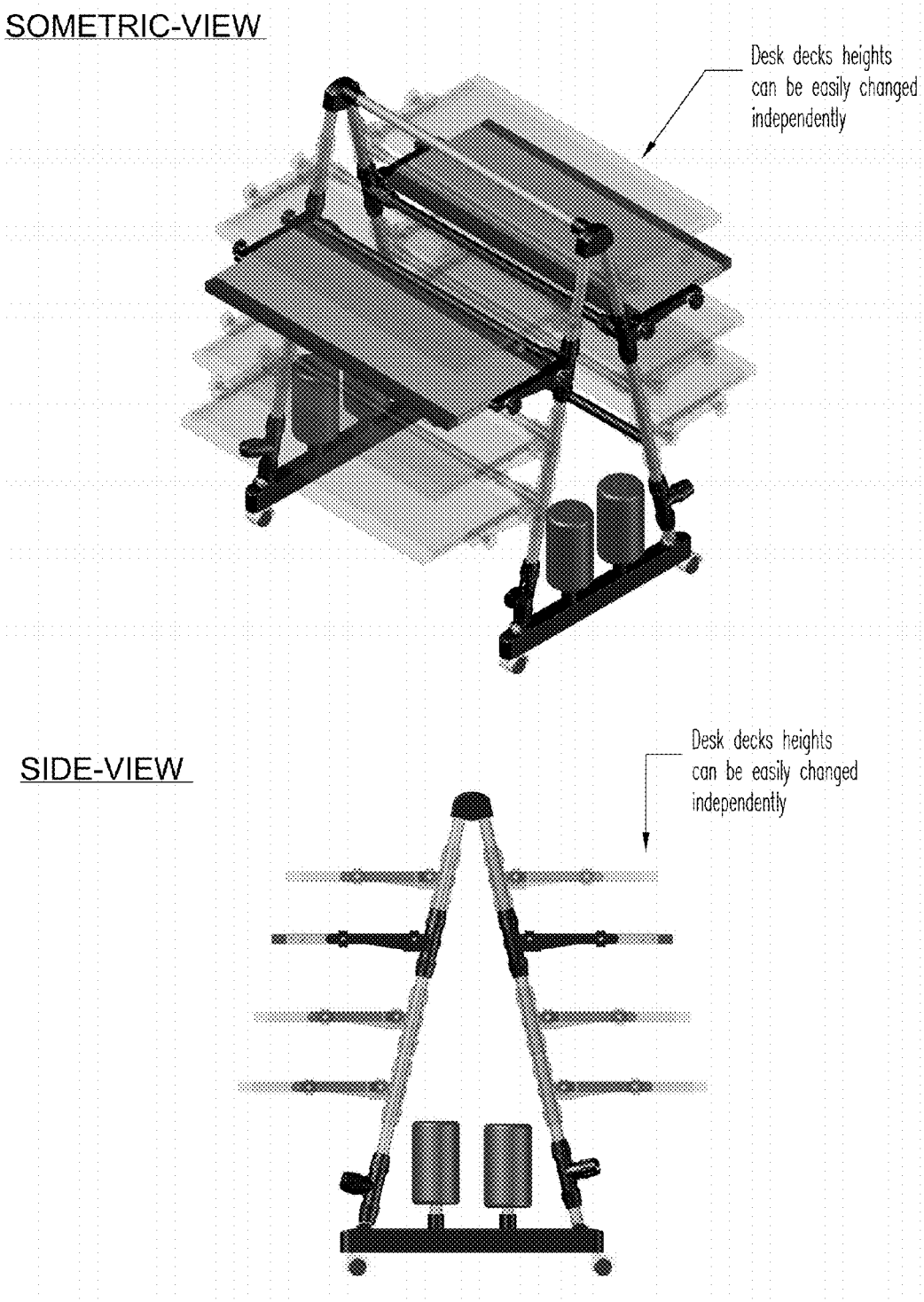

FIGURE 3: "Double Sided Desk"/ Decks working-plan versatility illustration/ Decks conversion from 'sitting' to 'laying-back' positions illustration.
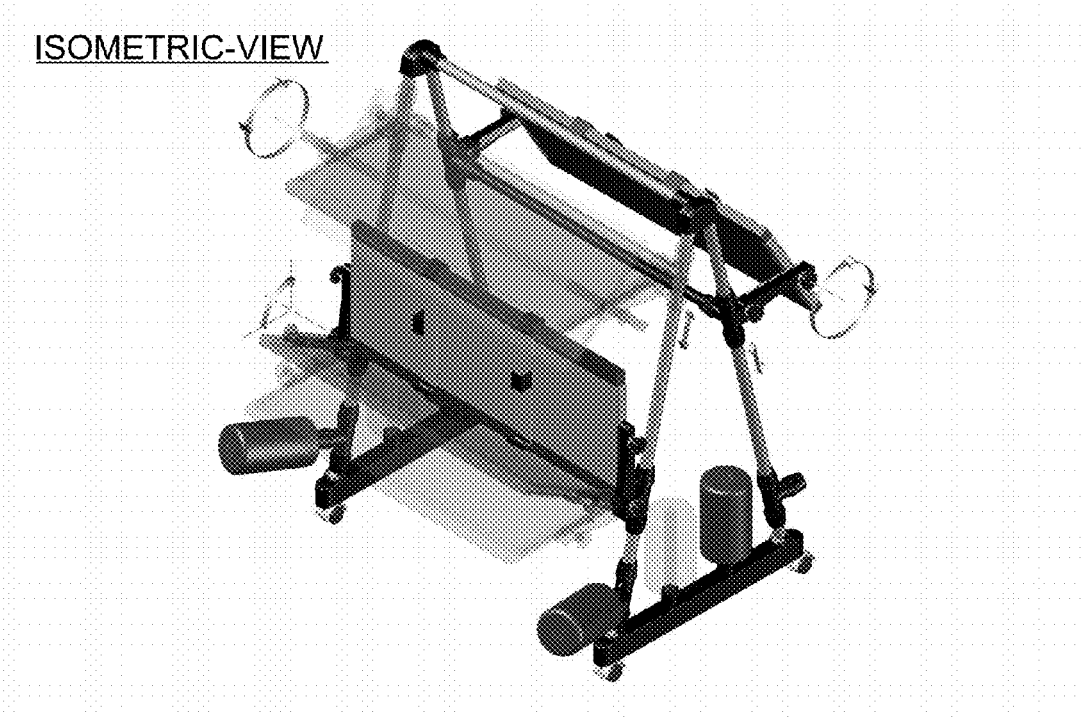
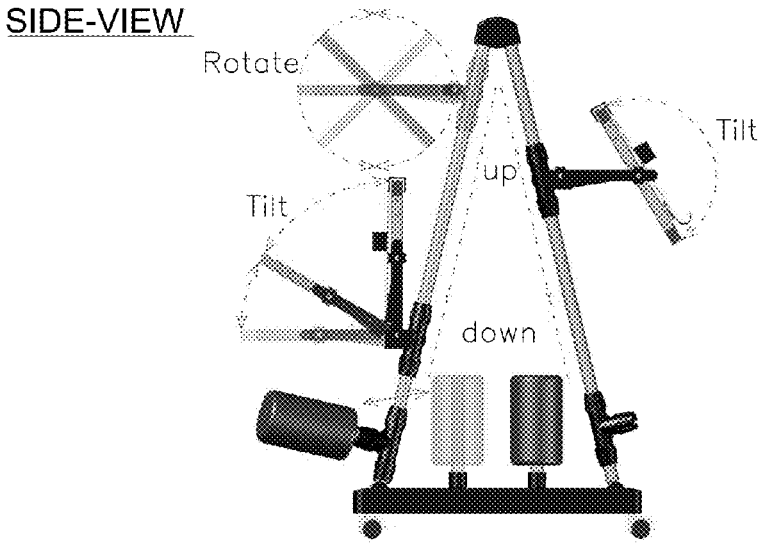

FIGURE 4: "Double Sided Desk"/ Adult & child in a sitting position illustration.
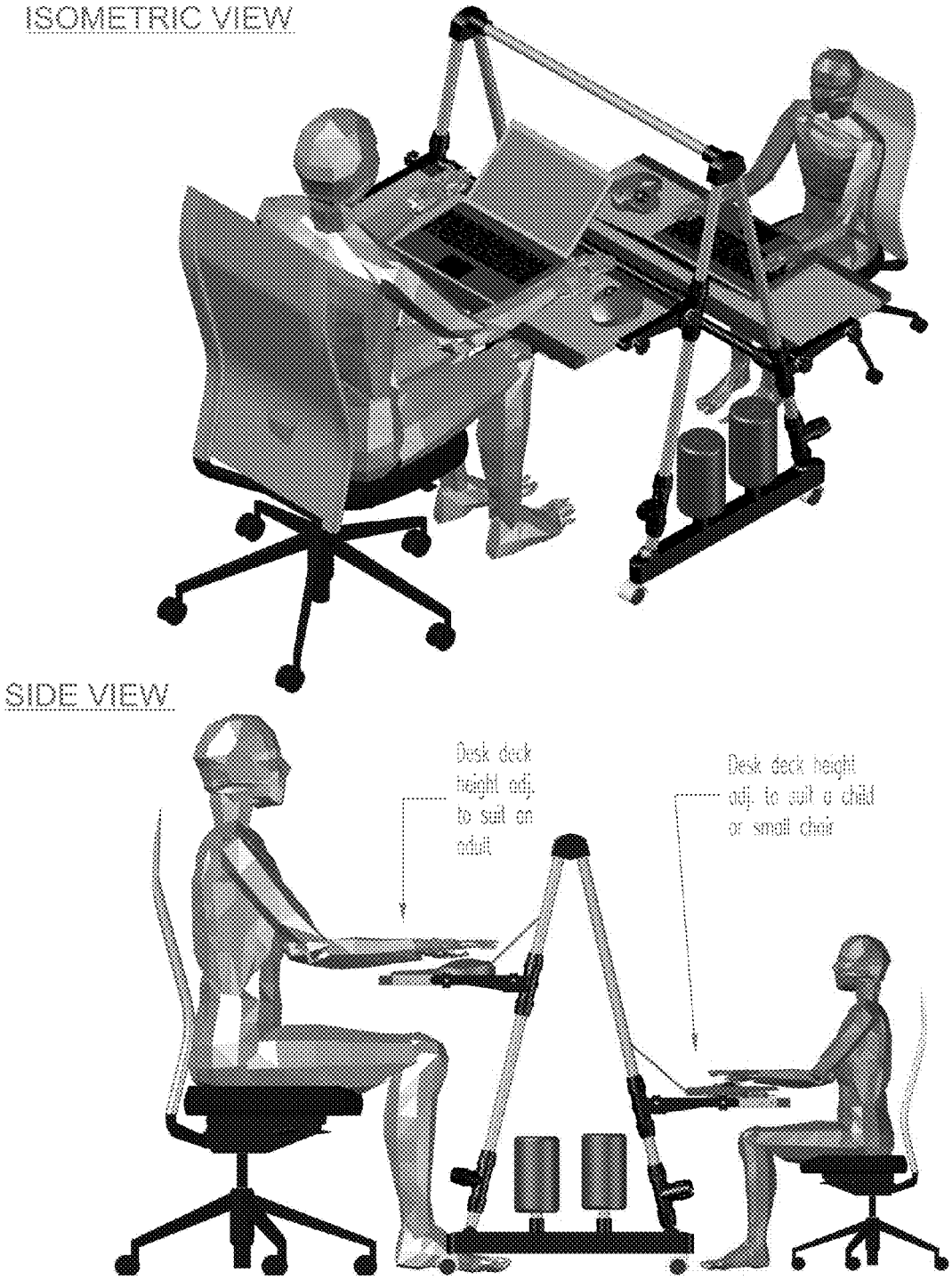

FIGURE 5: "Double Sided Desk"/ An adult in a laying-back position illustration. Refer to "LEGEND" on page 24.
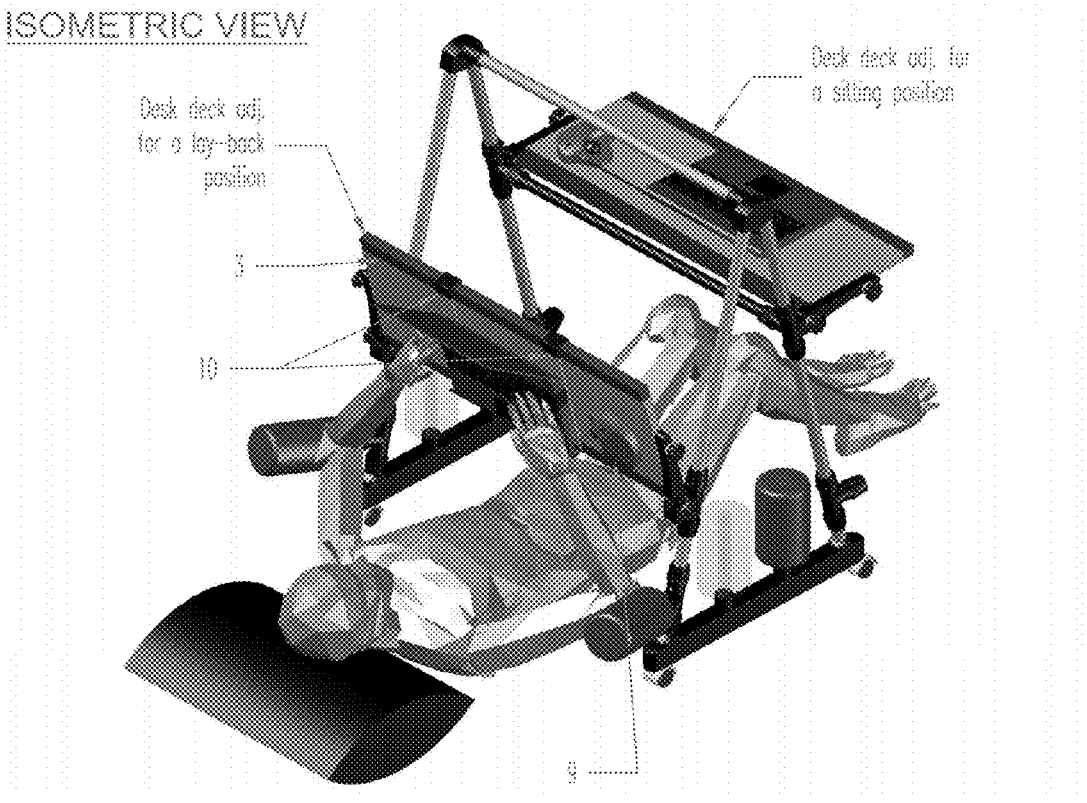
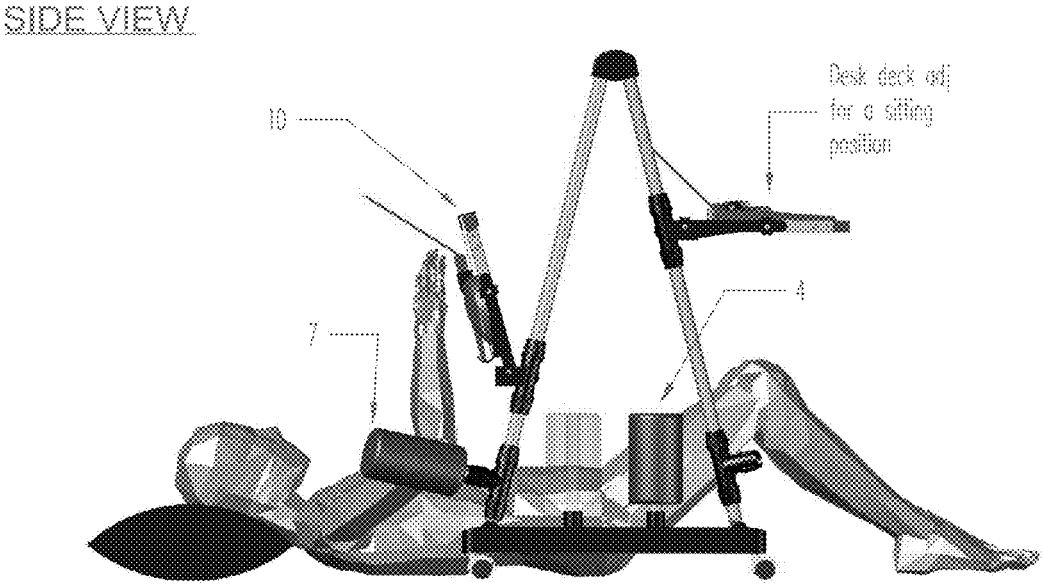

FIGURE 6: 3D computer generated model of the "Single Sided Desk" model. Refer to "LEGEND" on page 24.
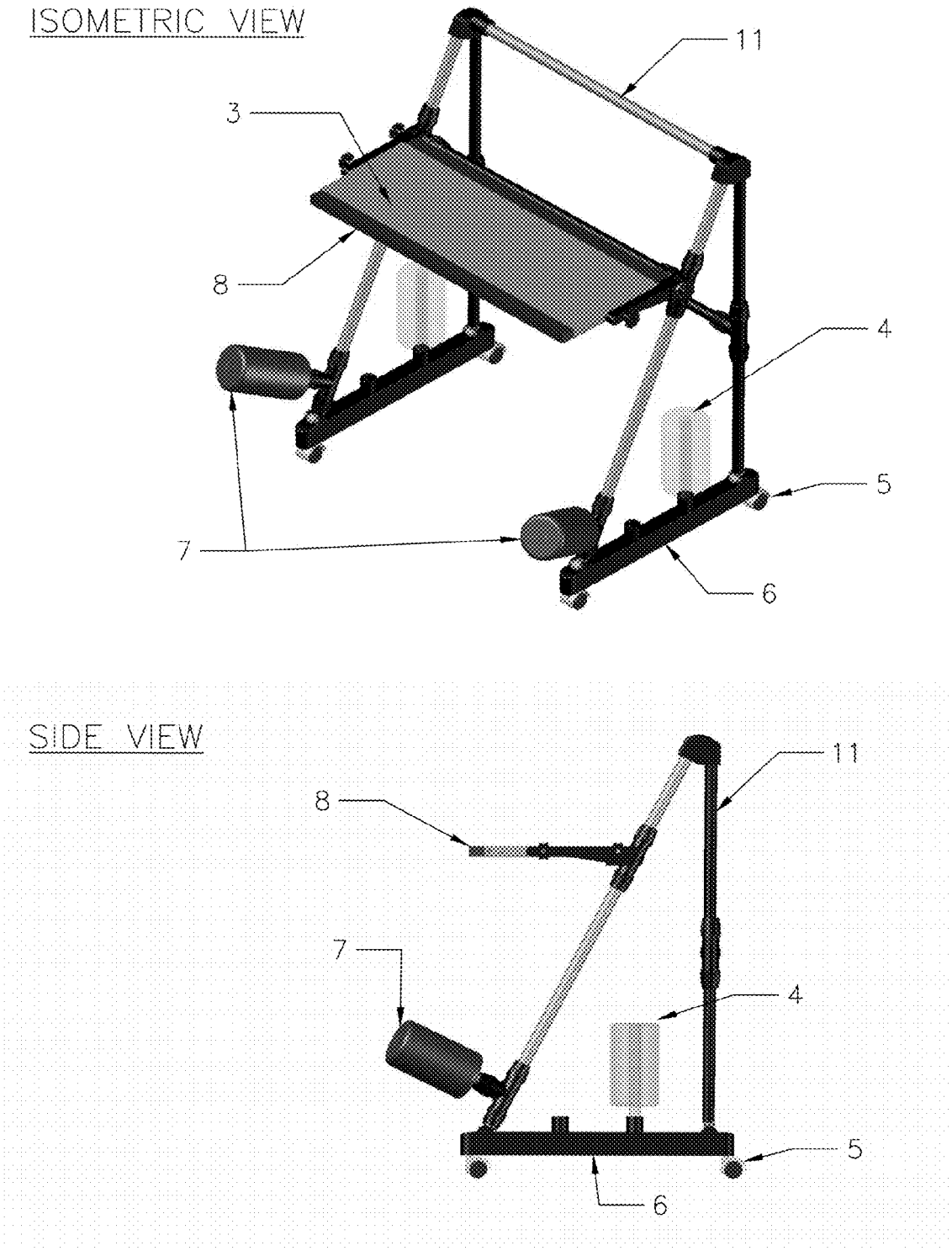

FIGURE 7: "Single Sided Desk"/ Deck height versatility illustration.
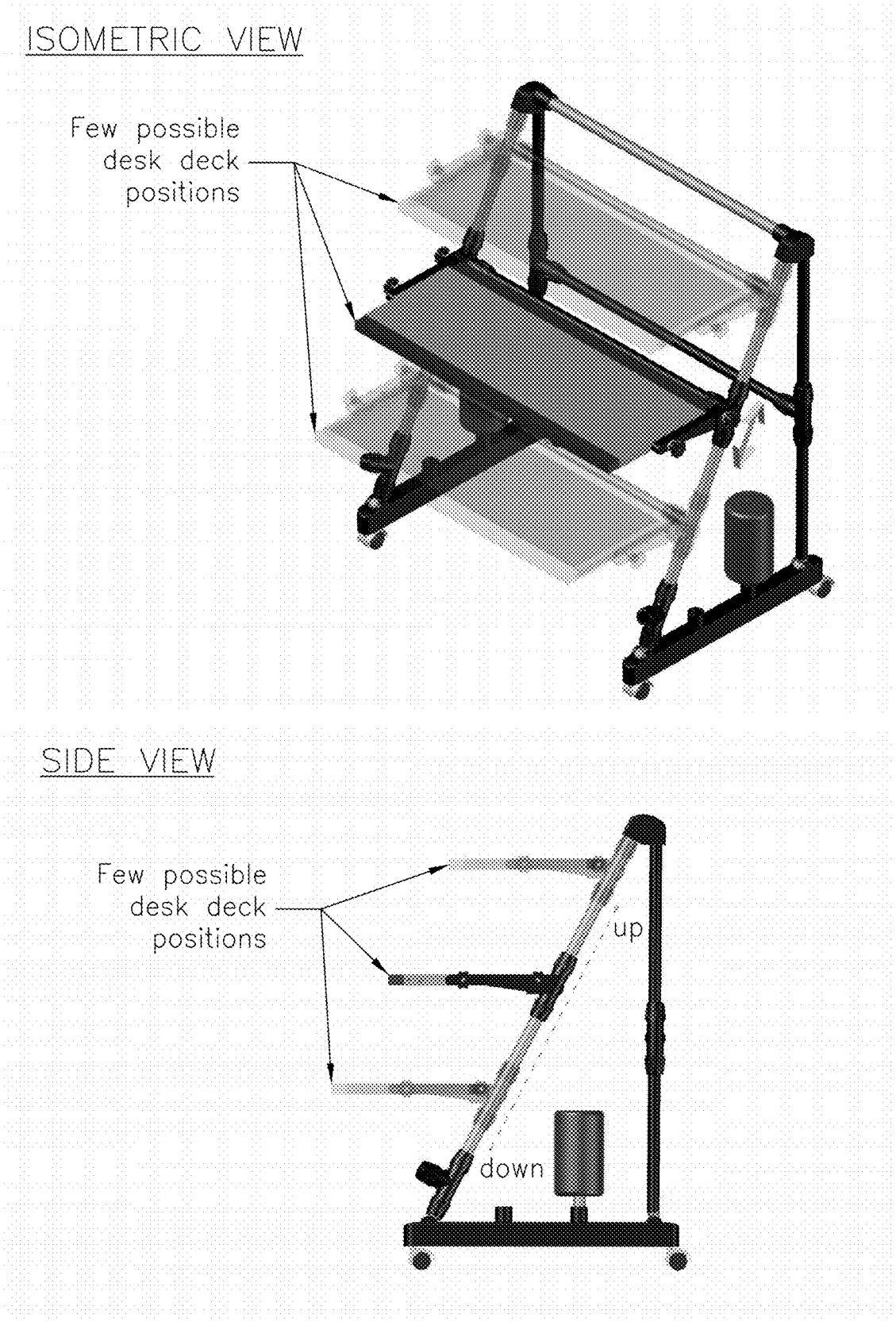

FIGURE 8: "Single Sided Desk"/ Deck working-plan versatility illustration/ Deck conversion from 'sitting' to 'laying-back' positions illustration.
ISOMETRIC VIEW
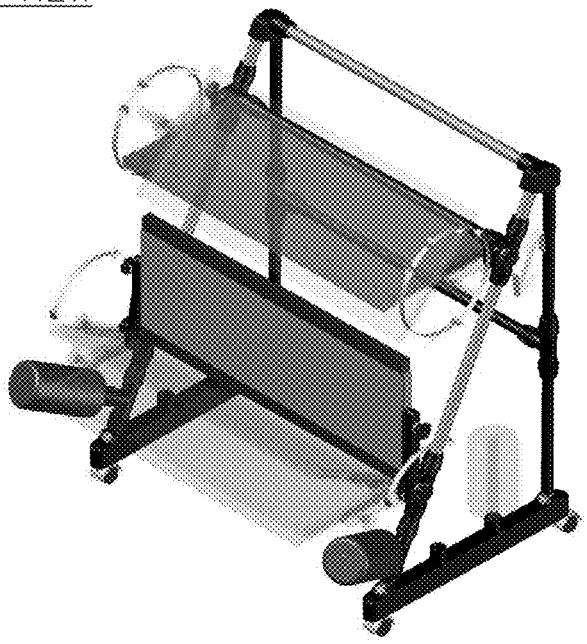
SIDE VIEW
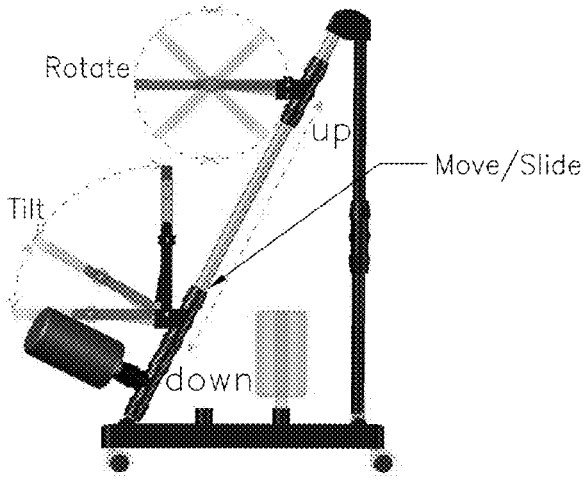

FIGURE 9: "Single Sided Desk"/ An adult in a sitting position illustration.
Refer to "LEGEND" on page 24.
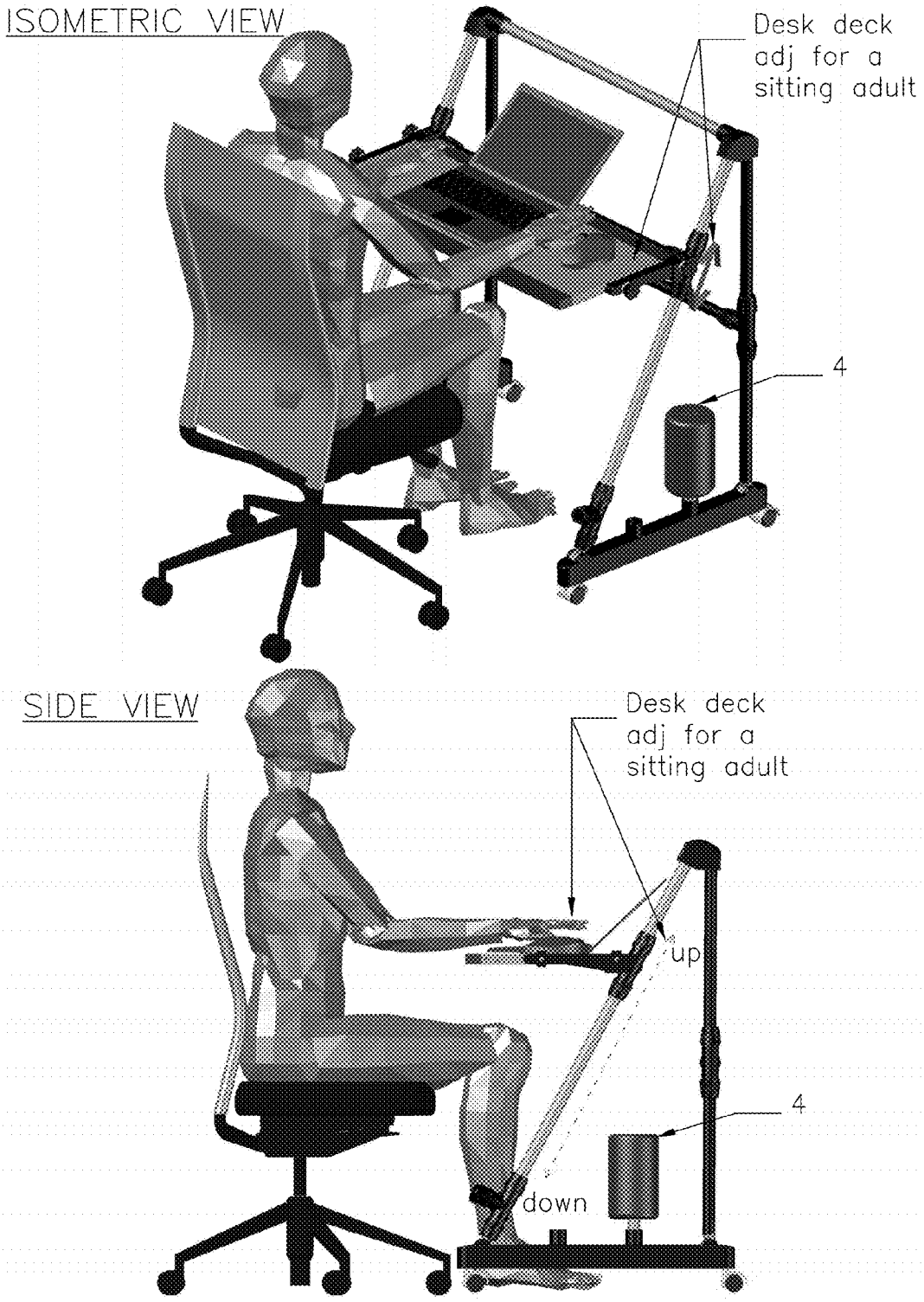

FIGURE 10: "Single Sided Desk"/ An adult in a laying-back position illustration. Refer to "LEGEND" on page 24.
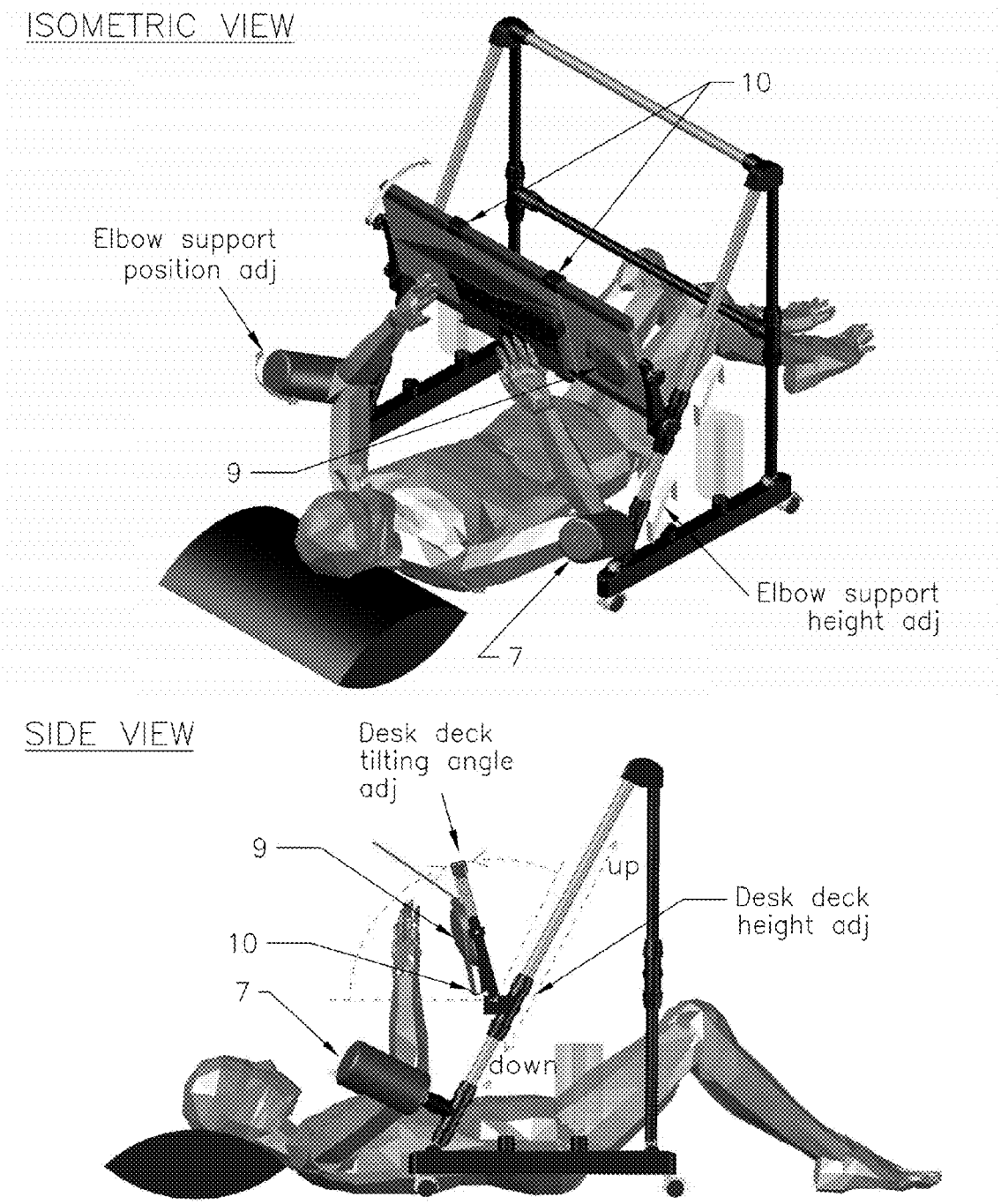

FIGURE 11: 3D MODEL WITH PARTS IDENTIFICATION
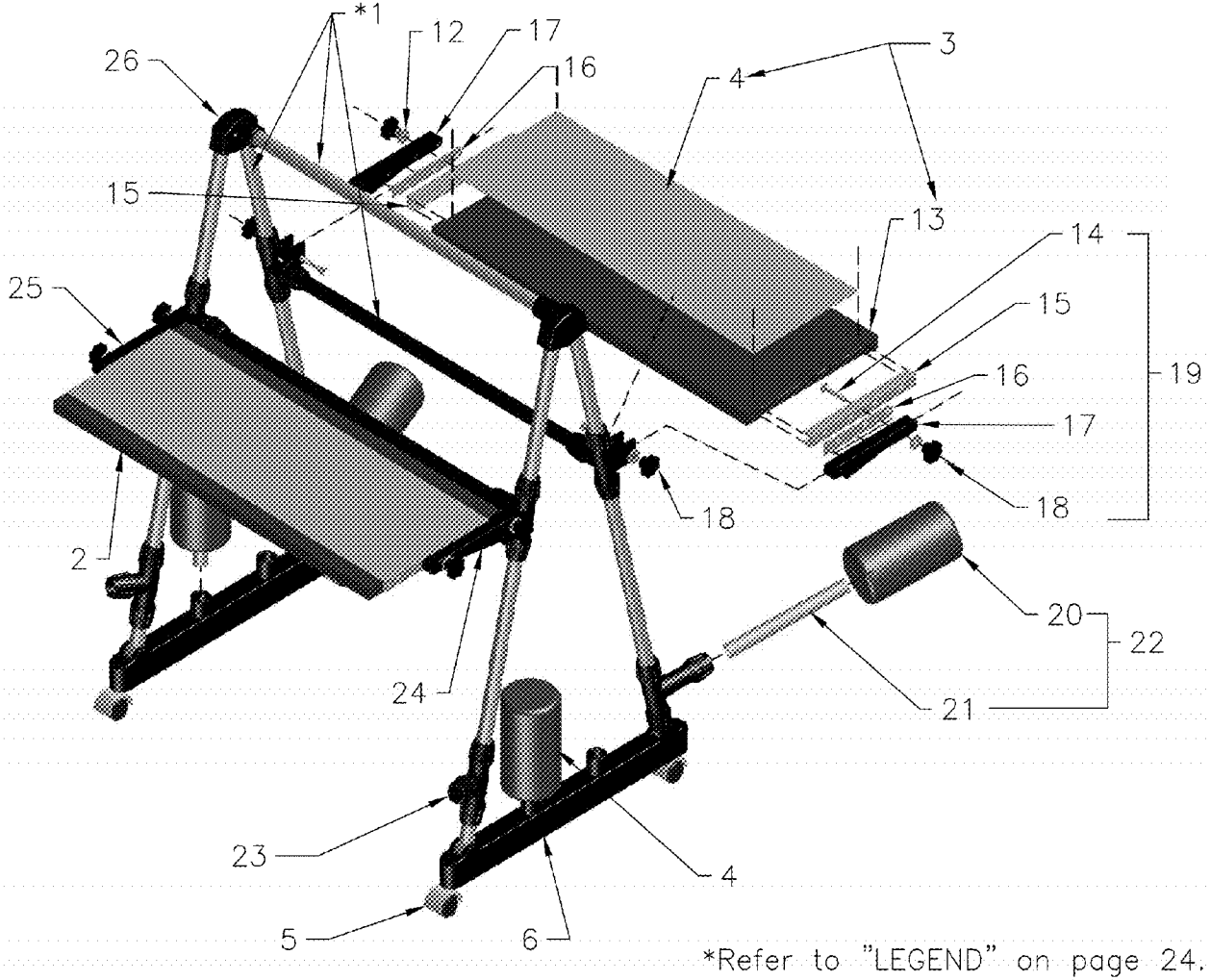

FIGURE 12: Laptop/ Book Holders: Refer to "LEGEND" on page 24.
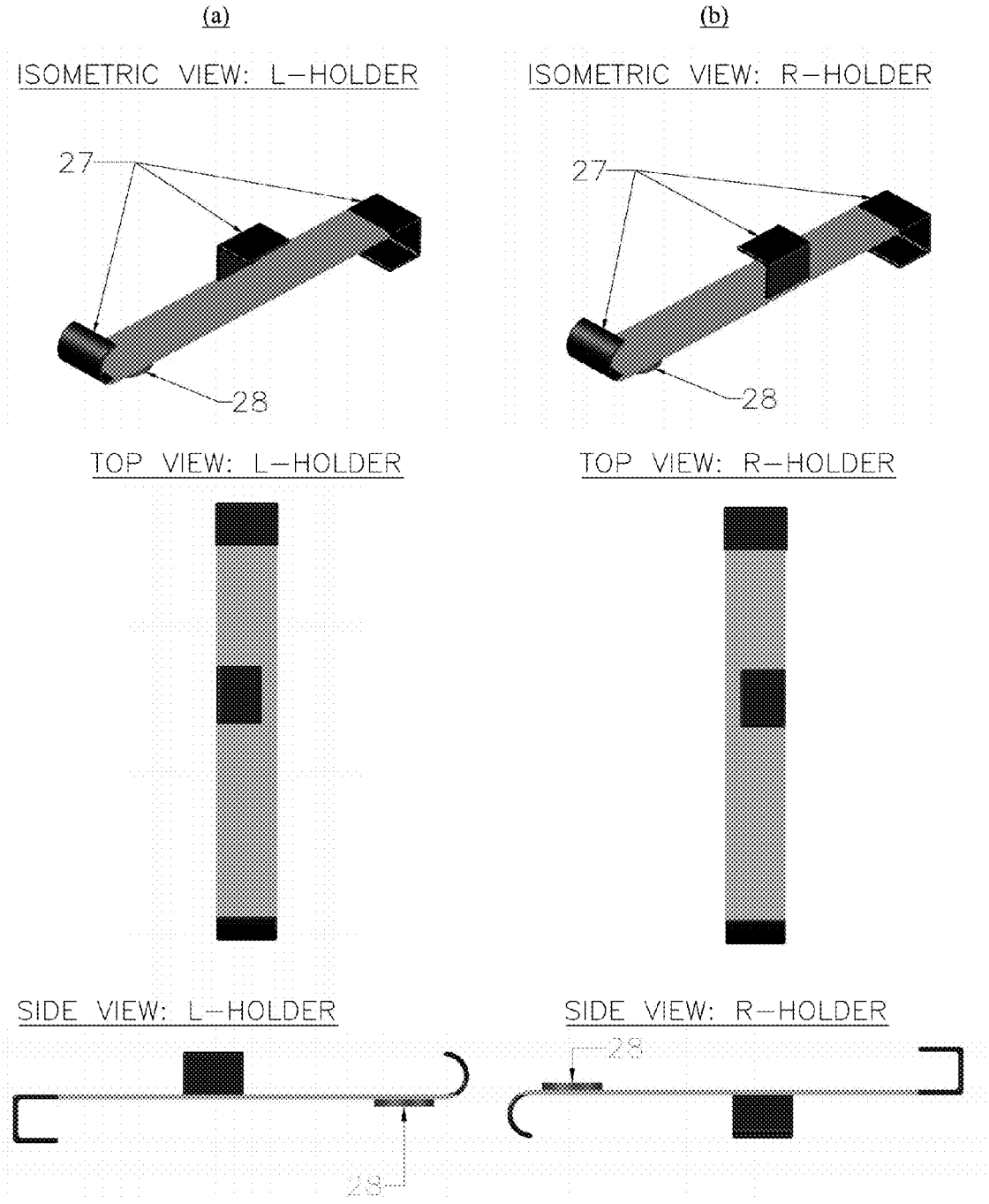

360 DESK/TABLE: BACK AND NECK SAVER AND PAIN RELIEVER DESK

FIELD OF THE INVENTION

This invention relates to the field of students and working parents home-desks and multipurpose tables for better health and back/neck pain relief. More specifically, this invention addresses two issues: First, the deformation of our spinal cords resulting from long working hours on school assignments and preparing for exams sitting behind our desks, which causes back and neck problems and leads to the Second issue: the inability to study or work when sitting behind a desk is required to do so.

BACKGROUND OF THE INVENTION

Being one of millions of people with lower back problem, sometime days pass by unable to do any work on my computer (from home), because I cannot sit behind my desk for more than 10-15 minutes (when my back problem is active) before the pain in my back becomes intolerable. More important, laying flat on my back, on the floor of my bed-/or living room for 1-2 hours after a long sitting hours in the office is one of my "must do" daily habit to rest my back for the next working day. Such habit can be very boring and time wasting without reading a book or surfing the net. However, reading a book or using a tablet while laying on your back on the floor causes painful strain in the arms and eyes and cannot be done longer than 10 minutes. All that has led me to the search for a solution.

While the market is full of products that offer some kind of alternatives to the tradition horizontal desk decks, non of them can replace the tradition desk. Furthermore, although some of those products can be used in bed, all of them, just like the tradition desk, required the head of the person to be higher than the deck of the desk/table. That is to say: they all require sitting down of some form in order to be used.

Therefore and as an engineer, I had to find a solution that allows me to work, read, search the Web, etc. laying totally flat on my back as I normally do sitting on a chair behind my desk. Thus, this invention has been developed, tried with a simple prototype and found to be very effective and practical. Unlike all available desks and tables and alike gadgets, this invention has versatile deck(s) that can be easily reset to suit everyone's needs, as it will be explained and shown later through computer generated 3D models.

BRIEF SUMMARY OF THE INVENTION

The present invention comprises a desk which has a versatile deck(s) position to suit people who suffer from problems in their spinal cords. It allows the use of the "desk" with the upper-body positioned at an angle ranging from 0°-to-90° with a vertical/horizontal plan. Thus, a user is able to adjust the elevation and the angle of the deck, with the horizontal plan, to suit any chair height and design. It also allows a user to lay-back flat on the floor and adjust the position of the desk, as a whole, and the height and angle of the deck to suit the user's eyes position and vision condition. This feature has been designed specifically for people who have problems with their spinal cords (or wish to protect their cords from deformation) and allows them to keep working and doing what others do. The elbow support makes it comfortable to work for long time with arms upwards.

Furthermore, the present innovation comprises two styles: "Single Sided Desk" and "Double Sided Desk" models. The "Double Sided Desk" offers two decks, one on each side, which can be independently adjusted and used. It can be used by two adults, an adult and a child, or by two children at the same time sitting opposite of each other. When used by a parent and a child, it may prove to be an effective strategy to encourage children to spend more time on their school assignments, etc. The "Single Sided Desk" has one deck and designed to be used by one person at a time.

Last but not the least, this invention comprises a desk that is very light in weight, can be easily moved around and does not required a designated fixed place in a room. Furthermore, it can be used as a table when a household is short on a table on a special events. It can easily brought out to the porch or balcony as an extra table, when needed.

BRIEF DESCRIPTION OF THE DRAWINGS/FIGURES

FIGS. 1-through-5 are computer generated 3D Model of the "Double Sided Desk" of this invention introducing this model and illustrating the unique functions of this desk as follows:

FIG. 1 shows structure and main parts of the "Double Sided Desk" model.

FIG. 2 illustrates the height versatility of the desk decks of this invention in the vertical, showing decks in various heights possible positioning.

FIG. 3 illustrates the plan versatility of the desk decks of this invention and the transformation process of the decks from a horizontal traditional sitting position into a full back-laying position.

FIG. 4 demonstrates a compo-use of this model by an adult and a child in a traditional upright-sitting position, showing the decks heights adjusted to suit each user's size and chair size requirements.

FIG. 5 demonstrates an adult laying-back flat on a floor and working on his/her laptop using this invented desk.

Similarly, FIGS. 6-through-10 are computer generated 3D Model of the "Single Sided Desk" of this invention introducing this model and illustrating the unique functions of this desk as follows:

FIG. 6 shows structure and main parts of the "Single Sided Desk" model.

FIG. 7 illustrates the height versatility of the desk deck of this invention in the vertical, showing the deck in various height possible positioning.

FIG. 8 illustrates the plan versatility of the desk deck of this invention and the transformation process of the deck from a horizontal traditional sitting position into a full back-laying position.

FIG. 9 demonstrates an adult in a traditional upright-sitting position, showing the deck height adjusted to suit the user's size and chair size requirements.

FIG. 10 demonstrates an adult laying-back flat on a floor and working on his/her laptop using this invented desk with elbows resting on the Elbow Support of the desk.

ADDITIONAL DRAWINGS

FIG. 11 shows parts identification and location of "Double Sided Desk" model.

FIG. 12 shows left and right "Laptop/Book Holders" and identifies their parts and features.

DETAILED DESCRIPTION OF THE INVENTION

Since the material the desks in this invention are made of are not the subject of the this invention, material used to build this desk according to this invention are NOT LIMITED TO THOSE MENTIONED HEREIN. Therefore, THIS PATENT APPLICATION OF THIS INVENTION SHALL COVER ALL POSSIBLE MATERIALS THAT MAY BE USED TO BUILD THE PRESENT INVENTION, as long as the functionality of the invention is not jeopardized.

Furthermore, the shape of the desk's main-frame, for both models, of this invention is also not the subject of this invention and NOT LIMITED TO THE TRIANGULAR SHAPE SHOWN IN THE SUBMITTED DRAWINGS. Therefore, THIS PATENT APPLICATION OF THIS INVENTION SHALL COVER "RECTANGULAR", SQUARE", "CIRCULAR", ETC. SHAPES FOR MAIN-FRAMES AS WELL, which can also be used for cosmetic decoration purposes.

That being said and referring to FIGS. 1 & 6, this invention can be divided into three-core-parts: The Frame, The Deck(s) (their structure, versatility and the way attached to the frame) and The Elbow Supports. As shown in those two figures, the Frames of both desks' models, the "Double Sided Desk" and "Single Sided Desk" respectively, has a triangular shapes (other shapes can be used as explained above). They are made of hollow stainless steel and painted round-tubes with plastic joints/fittings. Yet, the shapes and material of these parts can be replace with other shapes (e.g. square-tubes, triangular-tubes, etc.) and material (e.g. PVC, carbon, fiberglass, etc.). The Decks, the second core part, are made of wood with clued stainless steel sheet on one side covering most of its surface. Again, the decks can also be made of out any available material and not limited to my chosen preferences. These desks are not rigidly attached to the frames and can be moved up-&-down on the frames and rotated about two axes, as illustrated and explained in other figures. The function of this metallic sheet is to hold papers, books, etc. with the use of 'magnets' and other specifically made and supplied brackets when the desk is used with its decks positioned with angles greater than zero degree with the horizontal. Therefore, the material list of this sheet metal is limited to "magnetic metals" only, unless other means and accessories used to hold papers, books, etc. to the desk(s) deck(s).

The third core part, the Elbow Supports are made of foam. Their function is to support the arms when the desk is used in the full lay-back position. They can be relocated up and down on the frame to adjust for users' arms size and height of the deck. They can also be rotated inwards and outwards about the frame axis. The frame and everything else are carried on plastic (or any other material) bases and wheels for easy moving and relocating, as required demanded. Furthermore, its light weight allows a child to move it without parents' help. As a last note, the "Single Sided Desk" model is intended for the use of one person at a time while the "Double Sided Desk" model can be used by two persons at the same time.

FIGS. 2 & 7 illustrate the vertical versatility of the deck(s) of the desk in this invention. As shown in the figures and indicated by the "yellow arrows", the decks can be moved Up-&-Down along the desks' frames and re-positioned at any desired height, to suit users' sizes and chairs height. Furthermore, in the "Double Sided Desk" model, the position and movement of one deck is totally independent of the movement and position of the other deck. This feature of the invention allows the use of the desk by two users of differ sizes at the same time, e.g. an adult and a child. It also allows the use of any available chair(s).

FIGS. 3 & 8 illustrate the decks' angle versatility with a horizontal plan. As shown, it is possible to rotate the desk deck(s) of this invention about two horizontal-axes. The first axis, marked by "2" in FIG. 8, runs between the hinges of the brackets holding the decks to the frame. With this axis of rotation, the working-plan of the decks can be changed from a horizontal-plan to a vertical plan, including any-plan in between. This allows the desk of this invention to be used in any position from sitting straight-up to laying-back flat on a floor, for instance. The second rotation axis, marked by "1" in FIG. 8, runs between the brackets arms through the centers of the deck. This feature of the invention allows the tilting of the decks to accommodate users' comfort and working-position preferences. It also allows the face of the decks with the metal layer to be flipped downwards when the desk is used in a laying-back position. This feature of the invented desk(s) allows the use of various chair styles.

Referring to FIG. 4, the vertical versatility of the decks, which allows users to adjust the decks heights, comes very practical and handy when children, or toddlers, need to use the desk. Furthermore, if a chair with suitable height is not available, or if a child or toddler is keen on using his or her own "little chair", the decks of this innovated desk can be easily re-positioned to accommodate their little-bodies and little-chairs. As demonstrate in this figure, the "Double Sided Desk" model can be used by an adult and a child/toddler at the same time sitting opposite of each other. It can also be used by two adults or children at the same time. On the other hand, as demonstrate in FIG. 9, the "Single Sided Desk" model has all the features and versatility of the "Double Sided Desk" model except one feature: it can be used by one person, of any size and age, at a time.

Referring to FIGS. 5 & 10, the essential objective of this invention is demonstrated in these two figures. All features described earlier fall towards this objective. Thus, the goal of this invention is to help people with spinal-cord problems to work and rest their backs at the same time, when needed. The Structure and components of both desk models resulting from this invention allows a user, or users, to lay-back flat on the floor of his/her/their living/bedroom and use the desk as they normally do while sitting down on chairs. FIGS. 5 & 10 show an adult laying flat on his/her back with a pillow behind his/her head, elbows resting on the "Elbow Supports" and a Laptop strongly held to the deck of the desk with brackets (specifically designed and supplied for this purpose) and magnets and facing down toward the user. Furthermore, the mouse used and shown in the figures is readily available in the market and can be used in this position after sticking a "magnet tape" to its back and placing it on the magnetic metal surface of the deck. As mentioned at an earlier point, the distance of the laptop from the user's face and the tilting angle of the deck, and therefore the laptop, can be easily adjusted, along with the location and rotation of the elbow supports. This position can also be used by people who like to read while laying-back, or who wish to protect their spinal-cords from undesirable deformations and future problems.

Finally, in addition to the main parts described so far, there are a few other smaller parts required to build this desk. Some of these parts are readily available in the market (such as the washers), and others will require special fabrication. FIG. 11, in the ADDITIONAL DRAWINGS, shows a complete identification of all parts and their locations. As for accessories, FIG. 12 (in the ADDITIONAL DRAWINGS) shows one essential accessory—Laptop/Book Holder, which has a "LEFT" and "RIGHT" sides. FIG. 12*a* shows the left-side-holder and identifies its features. FIG. 12*b* does the same for the right-side-holder. More over, other accessories of less important function and role will be developed and designed through the continuous improvement process of this invention.

DRAWINGS LEGEND

| CODE | Description |
|---|---|
| 1 | Desk frame for 2-users |
| 2 | Right desk deck |
| 3 | Metal layer |
| 4 | Elbow-supports - in stand-by position |
| 5 | Swivel wheels |
| 6 | Frame base |
| 7 | Elbow-supports - in use position |
| 8 | Left desk deck |
| 9 | Mouse - held by magnet on the metal layer |
| 10 | Laptop/Book holders |
| 11 | Desk frame for 1-user |
| 12 | Washer |
| 13 | Desk deck board |
| 14 | Bolt |
| 15 | Desk Deck board sleeve |
| 16 | Spacer plate |
| 17 | Arm |
| 18 | Wing-nut |
| 19 | Components of the desk deck bracket - R/L |
| 20 | Elbow support cushion |
| 21 | Elbow-support arm |
| 22 | Components of the elbow-support |
| 23 | Elbow support bracket |
| 24 | Left desk deck bracket |
| 25 | Right desk deck bracket |
| 26 | Frame joint |
| 27 | Rubber coating |
| 28 | Magnet |

Having described my invention, I claim:

1. A 360 DESK/TABLE: BACK & NECK SAVER and PAIN RELIEVER DESK comprising:

a) one or more tilting desk decks, which can be independently adjusted in height and sloping angle, b) a frame, which allows vertical, horizontal and rotational movement of said deck(s) to any desired position within the height of the frame;

c) a plurality of desk-deck(s)-brackets—a left-bracket and a right-bracket per said desk deck, which hold said desk deck(s) and allows said desk deck(s) to be tilted and/or rotated around two axes in the xy-plane;

d) wherein said desk deck(s) is (are) attached to said frame by said desk-deck(s)-brackets—which allow user(s) to adjust the height of said desk deck(s) along the height of said frame;

e) a plurality of bases which are an integral part of said frame and are supported on wheels or slides; further comprising a plurality of slots for storing armrests when not in use;

f) a plurality of armrests (or elbow-supports) having first end and second end each, wherein second end is covered by thick foam or rubber for comfort;

g) a plurality of armrest-brackets, wherein first ends of said armrests are inserted in said armrest-brackets;

h) wherein said armrests are attached to said frame via said armrest-brackets below said desk-deck(s)-brackets—which allow user(s) to adjust positions of said armrests when user(s) is (are) in a lay-back position; and i) a plurality of laptop/book holders and various accessories.

2. A 360 DESK/TABLE: BACK & NECK SAVER and PAIN RELIEVER DESK as recited in claim 1, wherein said desk-deck comprising timber (or any other suitable material) board and metallic sheet covering at least one face.

3. A 360 DESK/TABLE: BACK & NECK SAVER and PAIN RELIEVER DESK as recited in claim 1, wherein said frame comprising a plurality of stainless steel pipe (or any other material and profile) and a plurality of joints (made of plastic or any other suitable material) connecting together said stainless-steel pipes.

4. A 360 DESK/TABLE: BACK & NECK SAVER and PAIN RELIEVER DESK as recited in claim 1, wherein said desk-deck-bracket (left of right) comprising:

a) a desk-deck-sleeve made of metal (or any other suitable material);

b) a spacer-plate made of metal (or other suitable material);

c) an arm made of metal (or any other suitable material); and d) a bracket-base made of metal (or any other suitable material);

e) wherein said desk-deck-sleeve is used to attach said desk-deck to said arm with said space-plate placed in between, and all held together with a bolt and wing-nut; further said arm is attached to said bracket-base with a bolt and wing-nut.

5. A 360 DESK/TABLE: BACK & NECK SAVER and PAIN RELIEVER DESK as recited in claim 1, further can be made of many different sizes and shapes/styles as long it keeps its intended functions.

* * * * *